US008272154B2

(12) United States Patent
Sapp et al.

(10) Patent No.: US 8,272,154 B2
(45) Date of Patent: Sep. 25, 2012

(54) FLIP BOOK GREETING CARDS

(75) Inventors: Dave Sapp, North Ridgeville, OH (US); David Mayer, Bay Village, OH (US); Eliza DeVogel, Lakewood, OH (US); Terry Hughes, Avon, OH (US); Johnny Yanok, Copley, OH (US)

(73) Assignee: American Greetings Corporation, Cleveland, OH (US)

( * ) Notice: Subject to any disclaimer, the term of this patent is extended or adjusted under 35 U.S.C. 154(b) by 15 days.

(21) Appl. No.: 12/945,032

(22) Filed: Nov. 12, 2010

(65) Prior Publication Data

US 2011/0107630 A1 May 12, 2011

Related U.S. Application Data

(60) Provisional application No. 61/260,508, filed on Nov. 12, 2009.

(51) Int. Cl.
*G09F 11/00* (2006.01)
*G09F 1/00* (2006.01)
*A63H 33/38* (2006.01)

(52) U.S. Cl. ..... 40/491; 40/124.09; 40/124.08; 446/151; 446/147; 116/321

(58) Field of Classification Search ..... 40/491, 40/124.09, 124.08; 446/151, 147; 116/321; 434/428

See application file for complete search history.

(56) References Cited

U.S. PATENT DOCUMENTS

| | | | | |
|---|---|---|---|---|
| 575,761 | A | | 1/1897 | Short |
| 584,311 | A | | 6/1897 | Marvin |
| 614,367 | A | | 11/1898 | Casler |
| 853,699 | A | | 5/1907 | Keen |
| 1,787,592 | A | | 1/1931 | Owens |
| 2,085,803 | A | * | 7/1937 | Harrison ..... 40/445 |
| 2,339,634 | A | | 1/1944 | Gross |
| 2,607,263 | A | | 8/1952 | Lazarus |
| 2,689,416 | A | | 9/1954 | Stoyanoff |
| 3,159,405 | A | | 12/1964 | Brambier |
| 3,593,432 | A | | 7/1971 | Reynolds |
| 3,740,128 | A | | 6/1973 | Adler |

(Continued)

OTHER PUBLICATIONS www.3dpapergraphics.com/specialty_mailers/flipbook/index.html.

*Primary Examiner* — Tashiana Adams
*Assistant Examiner* — Syed A Islam
(74) *Attorney, Agent, or Firm* — Roetzel & Andress; James C. Scott

(57) ABSTRACT

A flip book greeting card having an outside cover containing text and artwork and an inside panel containing a flip book. The flip book is made up of one piece of material that is folded accordion-style to create several smaller folds, each fold containing a series of still frame pictures or drawings, each successive fold containing the same picture or drawing with incremental movements. The flip book is connected to the greeting card in such away that when a user pulls the free edge of the flip book, the flip book is set in motion, creating the illusion of a picture in motion. The user may then push the free edge back to its original location, while the flip book is set in reverse motion, creating the illusion of rewinding the movement of the picture. The picture or drawing used in the flip book may be coordinated with the occasion, theme and/or décor of the greeting card.

19 Claims, 7 Drawing Sheets

U.S. PATENT DOCUMENTS 4,441,270 A * 4/1984 Crowell et al. ..... 40/534
4,952,051 A 8/1990 Lovell et al.
5,020,899 A 6/1991 Caston
5,171,038 A 12/1992 Bowler
5,678,822 A 10/1997 Setteducati
6,246,461 B1 * 6/2001 Hinsberg ..... 352/98
6,573,880 B1 6/2003 Simoni et al.
D531,215 S 10/2006 Spink et al.
7,415,789 B2 * 8/2008 Hluchan ..... 40/488
2003/0214128 A1 11/2003 Roberts et al.
2004/0082259 A1 * 4/2004 Yum ..... 446/151
2007/0109599 A1 5/2007 Schacht et al.

* cited by examiner

FLIP BOOK GREETING CARDS

RELATED APPLICATIONS

This application claims priority to U.S. Provisional Patent Application No. 61/260,508, filed on Nov. 12, 2009, which is incorporated herein by reference in its entirety.

FIELD OF THE INVENTION

This invention relates to greeting cards and more specifically to greeting card having a device contained therein having a series of successive pictures that are presented in rapid motion when a user pulls a pull tab.

BACKGROUND OF THE INVENTION

The concept of a "flip book" has been around for over 100 years. A flip book is a stack of sheets containing a series of still frame pictures bound together along one edge wherein each sheet contains an image with a small incremental movement over the picture preceding it in the stack. When the user flips through or otherwise rapidly moves through the series of images, the images appear to be in motion.

U.S. Pat. No. 575,761 describes "book-form kinetoscopes" having a series of leaves with successive images that are bound together at one end in book form and attached to a base. U.S. Pat. No. 584,311 describes a device having "picture cards" mounted and arranged so that by quickly moving the picture cards into the line of vision, the device gives the effect of movement. U.S. Pat. No. 614,367 contains a similarly arranged group of "picture cards" that are mounted radially onto the end of a bracket so that a user may hold the bracket in one hand and move the handle with the other so that the "picture cards" are successively brought into view. U.S. Pat. No. 853,699 describes a thick card containing a compartment for housing a "thumb book", wherein the top page of the "thumb book" is flush with the top surface of the card. The card eliminates the need for the user to grasp the bound edges of the "thumb book" and thereby interfering with the images contained on each page of the book. U.S. Pat. No. 1,787,592 describes a strip having a plurality of pictures on both sides thereof and arranged so that the strip may be folded to form a book that gives a motion picture effect to a user thumbing through the ends of the picture. U.S. Pat. No. 2,689,416 describes a device for aiding in rapid reading training. The device consists of a plurality of cards stapled together at one end and free at the other end and a spacer card providing a recess. U.S. Pat. No. 3,593,432 describes a booklet of transparencies made from selected frames of a motion picture of an expert showing exemplary movement. The transparencies are stacked together in succession and bound at one end by a gripper, allowing a user to flip through the transparencies to view the movement. U.S. Pat. No. 3,159,405 describes a deck of playing cards wherein the backs of the cards provide an object shown in different positions during movement so that combining the cards and flipping through them in rapid succession displays a motion picture effect. U.S. Pat. No. 5,171,038 describes a stack of sheets bound together by staples wherein the top of each sheet is imprinted with successive frames of a motion sequence. The device is then incorporated into an advertising device. U.S. Pat. No. 5,678,822 describes a deck of playing cards having, a first end portion marked with a first image and an opposite second end portion having a second image that is complementary to and inverted relative to the first image so that the first and second images provide an animated effect when the deck is flipped. U.S. Patent Application Publication No. 2003/0214128 describes a device having a plurality of pages with sequential images printed on both sides of the pages so that the book can be flipped through on one side displaying one animation and then it can be turned over and flipped through to display a second animation. The flipping ends of the pages are also cut so that the book is symmetrically beveled, thereby making the device easier to flip forwards or backwards.

In the past several years, there have been several advances in the sophistication and entertainment value contained in greeting cards. Consumers have indicated a desire to purchase greeting cards having an enhanced level of communication and amusement. One popular addition has been the use of electrically powered compact circuits contained within the panels of the greeting card which enable the creation of sound producing greeting cards. Pre-recorded audio clips can range from popular music, animals sounds, to celebrity voice messages. Sound is also used to create a more personal touch by providing mechanisms for recordable greeting cards, enabling a consumer to pre-record his/her own personal message to the greeting card recipient. Greeting cards have also been enhanced by video, light, moving parts and the inclusion of small token gifts or ornaments. It has become increasingly difficult to create new methods for providing increased entertainment and interactive value within a greeting card.

SUMMARY OF THE INVENTION

In one embodiment the flip book greeting card of the present invention includes a multi-panel greeting card body, a flip book panel operatively engaged with the multi-panel greeting card body such that a first portion of the flip book panel is fixedly attached to at least one panel of the greeting card and a second portion of the flip book panel is able to move linearly relative to at least one panel of the greeting card body. The flip book panel contains a plurality of sub-panels separated by fold lines, the sub-panels arranged in a sequential stacked configuration, a first sub-panel containing an animation printed thereon and each consecutive sub-panel in the sequence contains a slight variation in the animation of the previous sub-panel in the sequence. Linear movement of the second portion of the flip book causes the iteration of the plurality of sequentially stacked sub-panels creating the illusion of incremental movement of the animation printed thereon.

In another embodiment, the flip book greeting card contains a greeting card body having a first panel connected to a second panel along a first fold line and a third panel connected to the second panel along a second fold line, each panel having a front surface and a back surface. The third panel has a first generally elongated aperture located proximate to the center of the third panel and a second generally elongated aperture located proximate to a side edge of the third panel. Also included is a flip book panel having a first end and a second end opposite the first end and a plurality of fold lines between the first and second ends, wherein the flip book panel is folded along each of the plurality of fold lines creating a plurality of sub-panels, each sub-panel being arranged in a stacked configuration and containing substantially similar artwork printed thereon. The first end of the flip book panel is connected to the front surface of the third panel of the greeting card body and inserted through the first and second generally elongate apertures. The back surface of the third panel of the greeting card body is folded over the back surface of the second panel and attached thereto. Movement of the flip book panel away from the greeting card body causes sequential movement of each flip book sub-panel.

DETAILED DESCRIPTION OF PREFERRED AND ALTERNATE EMBODIMENTS

The flip book greeting card of the present disclosure and related inventions presents a novel new greeting card by combining the traditional greeting card features of text and artwork printed upon two or more panels with a three-dimensional folded construct. The folded construct is articulated and can be put into motion in the manner of a flip book having multiple interconnected panels which are moveable as double-sided images irk sequence to create the impression of a moving image by the succession of images or scenes printed on the interconnected panels which constitute the pages of the flip book. The flip book greeting card thus has dual functionality of a card with card panels and the associated front and back pages of each panel, and an integral and operational folded construct which operates as a flip book by operation of a slide out pull tab which is manipulated linearly relative to one of the panels of the greeting card.

Figure 1:
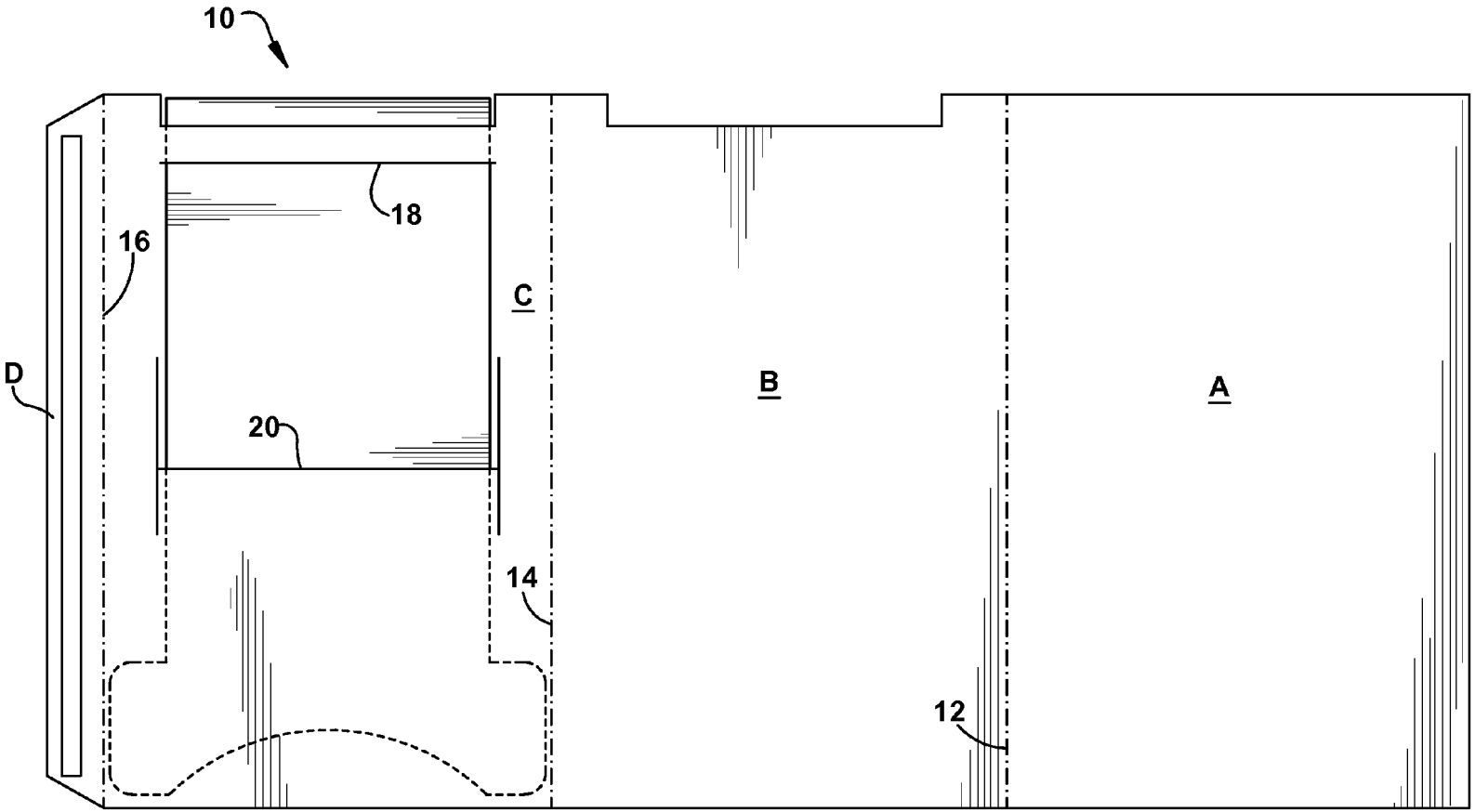
FIG. 1 is a representative die cut for the body of the flip book greeting card of the present invention.

Turning to the drawings and particularly to FIG. 1, the flip book greeting card of the present invention contains a main greeting card body 10 having a first panel A attached to a second panel B along fold line 12, the second panel attached to a third panel C along fold line 14 and the third panel C attached to tab D along fold line 16. The second B and third C panels having a rectangular shaped cut-out or indentation along a side edge of each panel to accommodate the flip book pane) described in further detail below. The cut-out or indentation may be located along the left or right sides of the second B and third C panels. The third panel C also contains a slot or opening in the panel formed by two elongated apertures 18, 20 contained within the panel. The greeting card body 10 is preferably made of card stock but can also be made of paper, cardboard, or any other suitably strong material.

Figure 2:
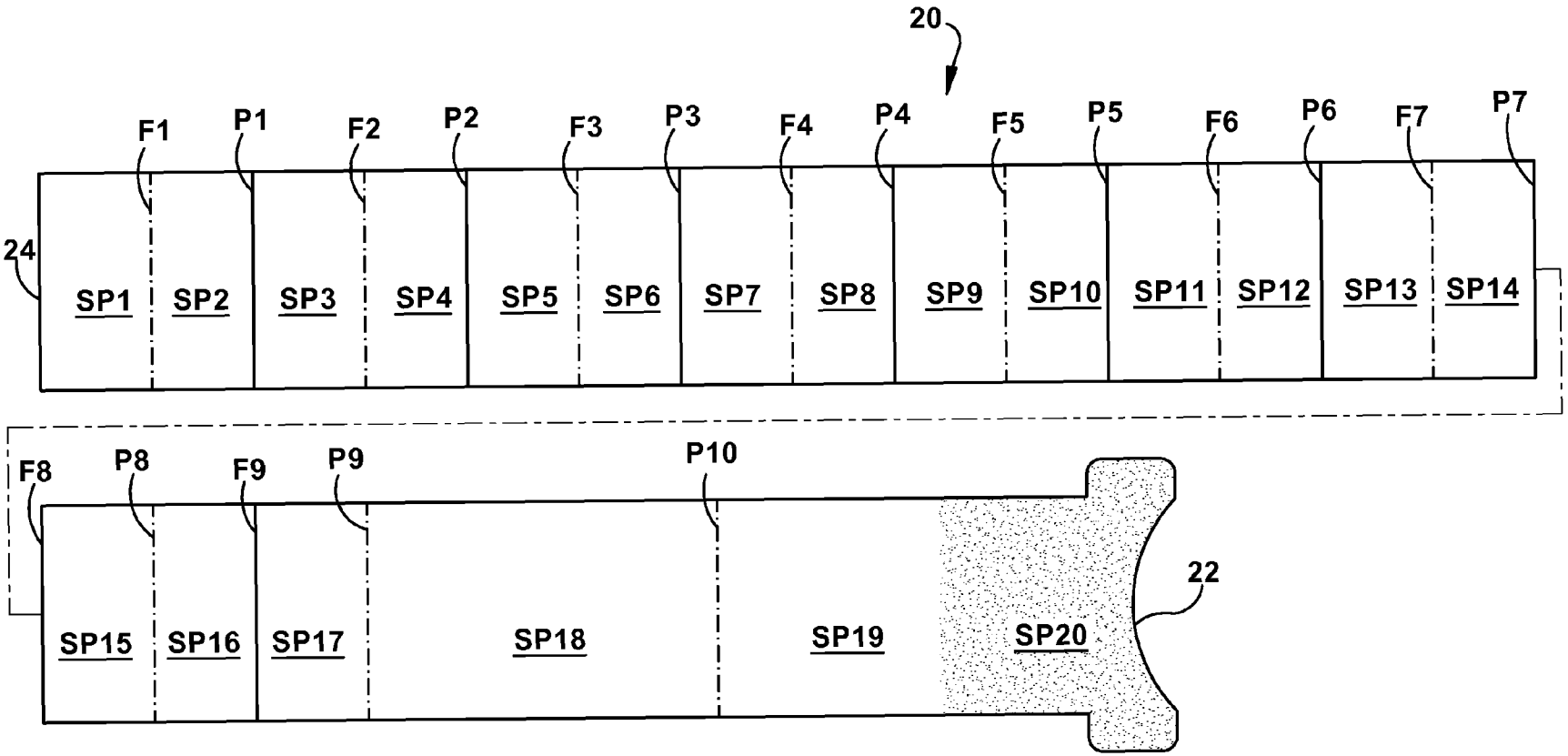
FIG. 2 is a representative die cut of the flip book assembly which fits within and cooperates with the body of the greeting card.

The die cut of the flip book assembly, shown in FIG. 2, has a first end 22 and a second end 24, the first end being a tab having a slightly larger width than that of the flip book panel 20. The first end 22 also contains an inwardly arched side edge. The second end 24 contains a straight edge. The body of the flip book panel 20 contains a series of fold lines F1-F9 and panel lines P1-P10 creating several sub-panels SP1-SP20. All sub-panels with the exception of sub-panel SP20 contain text and/or artwork that together make up an animation or motion sequence. Two consecutive sub-panels contain one full frame in the motion sequence. For example, sub-panels SP1 and SP2 make up one full frame. There is one panel line located between each two panels or each full frame. For example, sub-panel SP2, which along with sub-panel SP1 makes up the first full frame, is connected to sub-panel SP3, which along with sub-panel SP4 makes up the second full frame, along panel line P1. Each full frame is folded along each panel line so that the sub-panels adjacent to the panel line are connected to each other, adhesively or otherwise, along the back side. For example, sub-panels SP2 and SP3 are folded outward along panel line P1 so that the back of sub-panel SP2 is attached to the back of sub-panel SP3 and sub-panels SP4 and SP5 are folded outward along panel line P2 so that the back of sub-panel SP4 is attached to the hack of sub-panel SP5, etc. Once all sub-panels have been folded and attached along each panel line, each panel is folded inward along each fold line so that adjacent sub-panels are facing each other in a stacked arrangement. For example, sub-panel SP2 is folded inward along fold line F1 so that the front of sub-panel SP2 is directly on top of and facing the front of sub-panel SP1. Sub-panel SP19 is folded downward along panel line P10 such that the back side of sub-panel SP19 is attached, adhesively or otherwise to the back side of sub-panel SP18. Now the first end of the flip book panel has a straight edge (along panel line P10).

To assemble the flip book panel 20 within the body of the greeting card 10, the first or tabbed end 22 of the flip book panel 20 is inserted through both openings 18, 20 in the third panel C of the body of the greeting card 10, as shown in FIG. 1. The bottom surface of the second end 24 of the flip book panel is attached, adhesively or otherwise, to the front surface of the third panel C of the greeting card 10, such that the edge of sub-panel SP1 along fold line F1 aligned with one of the openings 20 in panel C. Both sub-panels SP1 and SP2 are open and visible on the front face of panel C. The edge of sub-panel SP18, along panel line P10, is flush with the edge of panel C and the remaining sub-panels of the flip book are folded in a stacked arrangement beneath sub-panels SP1 and SP2 and partially under panel C via opening 20. Sub-panel SP18 also referred to as the slide out pull tab, controls the incremental forward and backward motion of the flip book by movement of the slide out pull tab.

To assemble the entire greeting card, panel C, along with the attached flip book panel 20 is folded along fold line 14 and the tab D is folded downward along fold line 16 so that the front of tab D is attached, adhesively or otherwise, to the top of panel B right below fold line 12. Panel A is then folded along fold line 12 and serves as the front panel of the greeting card. The slide out pull tab SP18 is used to change positions or frames of the flip book by movement of the slide out pull tab from an initial position wherein it is substantially received or hidden within the body of the greeting card in the cavity between greeting card panels B and C (shown in FIG. 3) to an end position wherein the pull tab is substantially outside of the greeting card body (shown in FIG. 5). The tabbed end 22 located at the end of sub-panel SP20 prevents the slide panel from being entirely removed from within the body of the greeting card.

Figure 3:
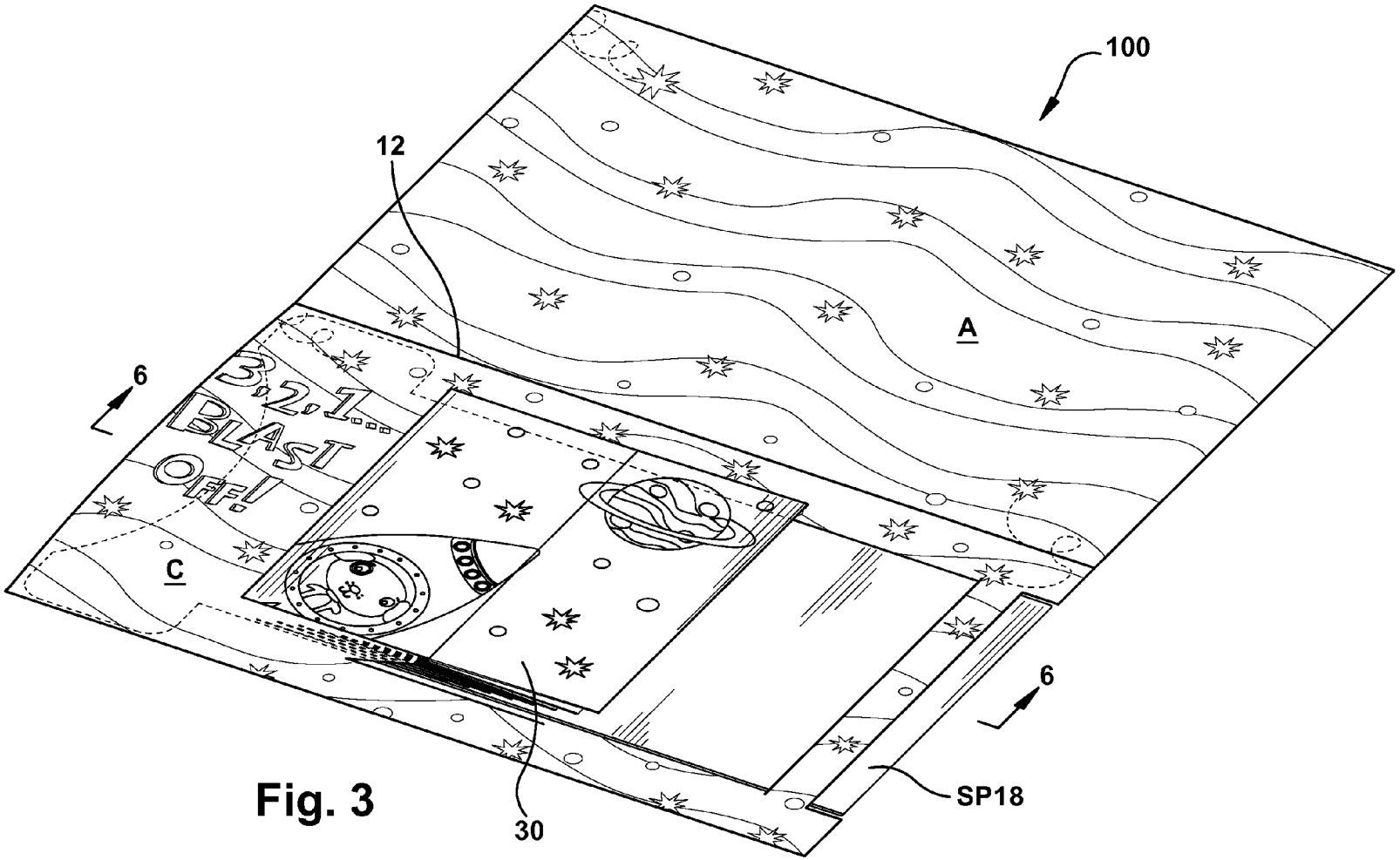
FIG. 3 is a perspective view of the flip book greeting card in an initial position
Figure 4:
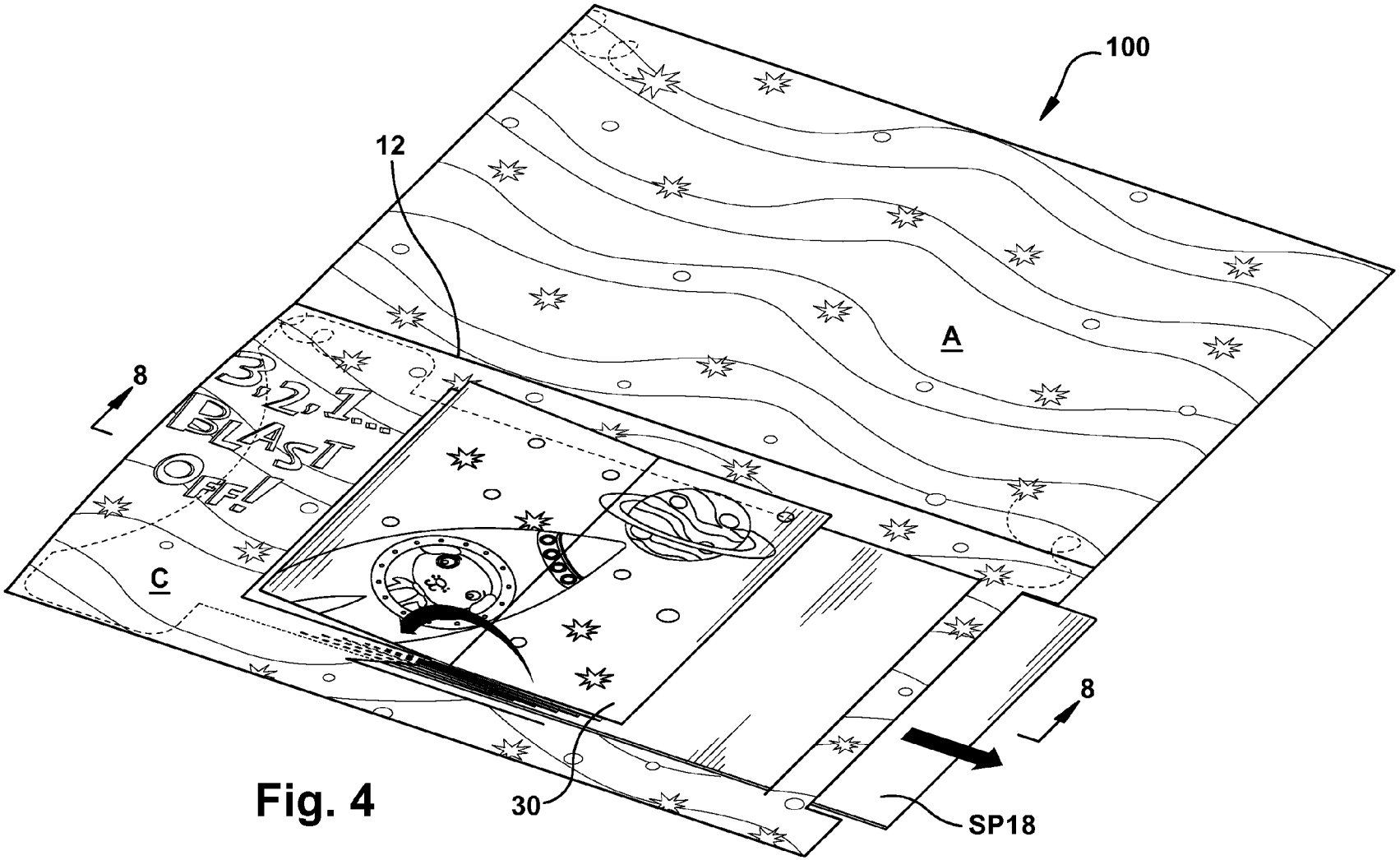
FIG. 4 is a perspective view of the flip book greeting card of FIG. 1 in an intermediary position.
Figure 5:
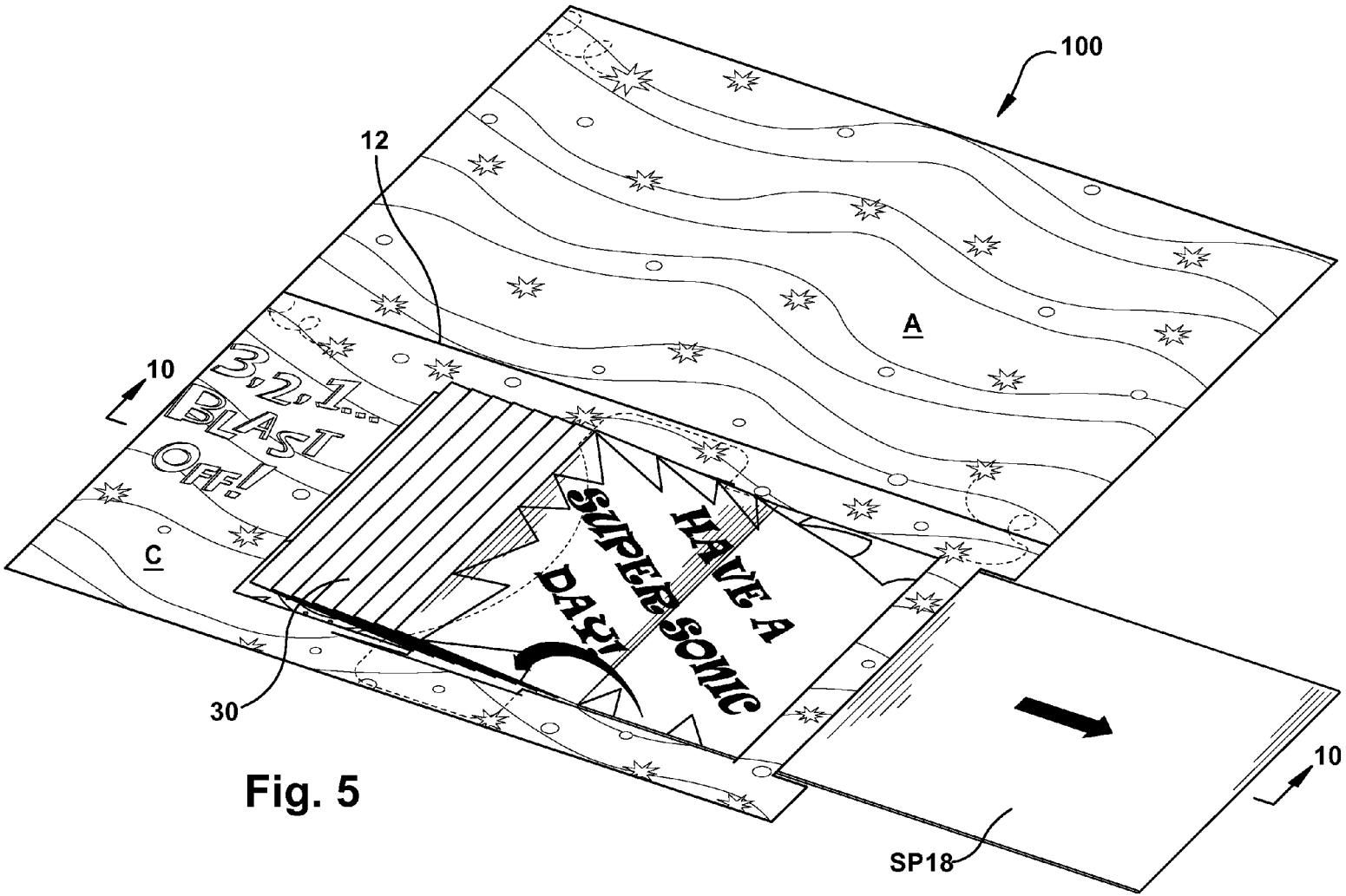
FIG. 5 is a perspective view of the flip book greeting card of FIG. 1 in an end position
Figure 6:
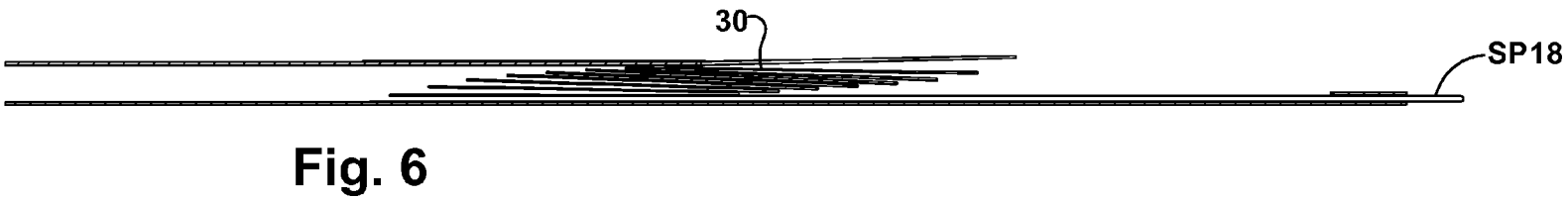
FIG. 6 is a cross-sectional view of the flip book greeting card of FIG. 1, viewed in the direction of arrows 6-6.
Figure 7:
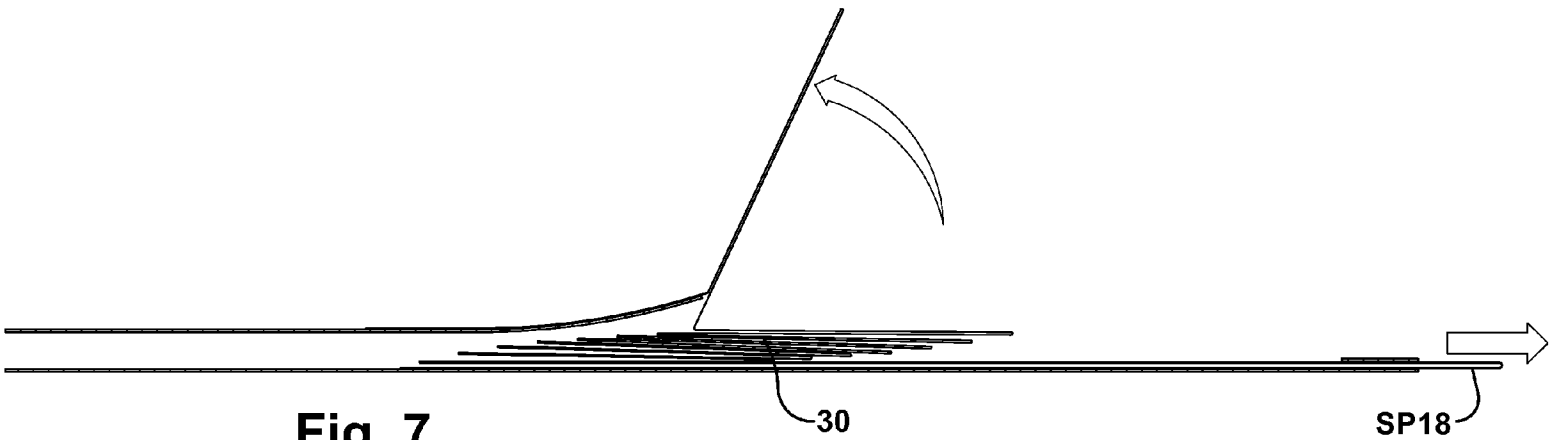
FIG. 7 is a cross-sectional view of the flip book greeting card of FIG. 6, showing movement of the first flip book frame or page from the right to the left.
Figure 8:
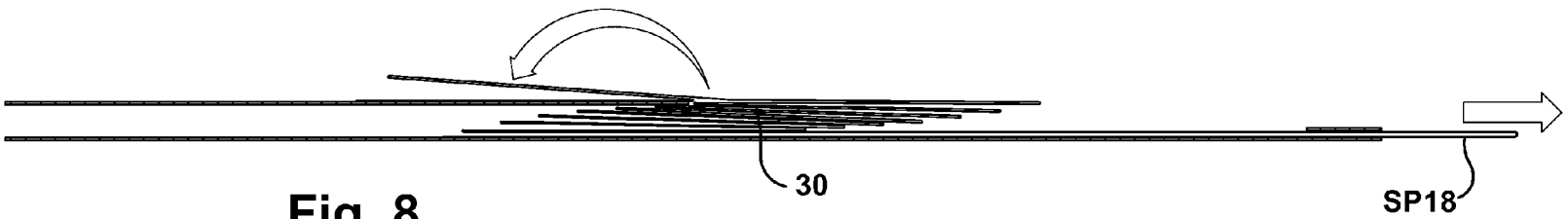
FIG. 8 is a cross-sectional view of the flip book greeting card of FIG. 2, viewed in the direction of arrows 8-8.
Figure 9:
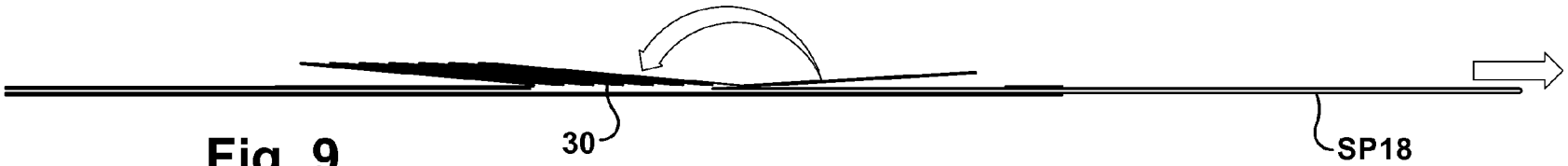
FIG. 9 is a cross-sectional view of the flip book greeting card of FIG. 1, in position showing the next to last frame.
Figure 10:
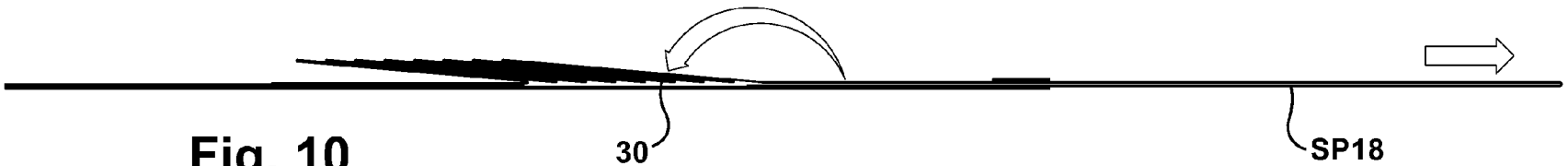
FIG. 10 is a cross-sectional view of the flip book greeting card of FIG. 3, viewed in the direction of arrows 10-10.

As shown in FIG. 3, the flip book assembly 30 is positioned between inside panels A and C of the greeting card 100. When the user opens the greeting card 100 by lifting the panel A in an upward direction along fold line 12, the inside of the greeting card and flip book assembly 30 is revealed. Movement of the frames of the flip book assembly 30 is controlled by the slide panel SP18, which in an initial position is substantially within the body of the greeting card in the cavity formed between the panel B and panel C. When the slide panel SP18 is fully contained within the body of the greeting card such that the edges of the slide panel SP18 are even with the side panel of the greeting card, as shown in FIG. 3, the flip book assembly 30 is in an initial position showing a first frame of the animation. A cross-sectional view of the flip book assembly in its initial position is shown in FIG. 6. In this initial position, all of the folded frames of the flip book 30 are stacked atop each other in a staggered arrangement. As a user begins to pull the slide panel SP18 outward in a lateral direction away from the greeting card 100, the pages of the flip book 30 begin to turn to the left, as shown in FIG. 4 and FIGS. 7-9. Once the slide panel SP18 is moved to an end position wherein a significant portion of the slide panel SP18 is revealed outside of the greeting card body, the flip book animation is complete with the final frame of the animation visible, as shown in FIG. 5 and FIG. 10. The final frame may have a birthday greeting or other occasion specific message printed thereon. The faster the slide panel SP18 is pulled outward from within the greeting card body, the faster the animation is revealed, giving the illusion of the a moving animated sequence. Once the slide panel SP18 is in the end position, revealing the final frame, pushing the slide panel in the opposite direction back into the body of the greeting card reverses the sequence of the flip book frames, showing the animation in reverse.

In another embodiment, the flip book greeting card of the present invention may contain sound capability. For example, the greeting card may additionally contain a sound module containing a circuit board and electrical components including but not limited to a speaker, a microphone, one or more batteries, an integrated circuit, and one or more switches which control activation of the sound. Pre-recorded sound may be contained within the sound module and/or the card may provide the ability to record a personal greeting which will be stored in the sound module. The pre-recorded or personalized recordings may be triggered by a switch contained within the greeting card which may be a slide switch which triggers sound upon opening the greeting card. Alternatively, the greeting card may contain a push button switch which activates the recording upon compression thereof. The switch may work in combination with the flip book wherein when the slide panel is removed from within the greeting card body, the sound recording is initiated. The switch may be a slide switch, a light activated switch, a motion activated switch, a touch sensor switch, a magnetic switch, of any other type of switch. The sound module and related electronic circuitry may be concealed within the body of the greeting card, such as perhaps within the cavity formed between panels B and C.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. For example and without limitation, other embodiments with the scope of the disclosure and related inventions include greeting cards of other configurations, such as gate-fold, tri-fold and multi-fold/multiple panel greeting cards, and one or more flip book mechanism or similar folded constructs integrated with on or more panels of a greeting card, and in any particular orientation with respect to the panels wherein a pull-tab actuator may extend from any particular edge or surface of any particular panel. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A greeting card comprising:

a multi-panel greeting card body;

a flip book panel operatively engaged with the multi-panel greeting card body such that a first portion of the flip book panel is fixedly attached to at least one panel of the greeting card and a second portion of the flip book panel is able to move linearly relative to at least one panel of the greeting card body, the first and second portions of the flip book panel comprising a single contiguous panel the flip book panel having a plurality of sub-panels separated by fold lines, the plurality of sub-panels arranged in a sequential stacked configuration, a first consecutive pair of sub-panels containing an animation printed thereon and each subsequent pair of sub-panels in the sequence containing a slight variation in the animation of the previous pair of sub-panel in the sequence, wherein linear movement of the second portion of the flip book causes iteration of the plurality of sequentially stacked sub-panels creating the illusion of incremental movement of the animation printed thereon.

2. The greeting card of claim 1, wherein the greeting card body has three panels attached along two fold lines.

3. The greeting card of claim 1, wherein the flip book panel is attached to an inside panel of the greeting card body.

4. The greeting card of claim 1, wherein the flip book panel is attached to a front cover of the greeting card body.

5. The greeting card of claim 1, wherein the linear movement required to iterate through the plurality of flip book sub-panels is in a lateral direction.

6. The greeting card of claim 1, wherein the linear movement required to iterate through the plurality of flip book sub-panels is in an up or down direction.

7. The greeting card of claim 1, wherein artwork and/or text sentiment printed on the greeting card body is complementary to the animation printed on the plurality of flip book sub-panels.

8. The greeting card of claim 1, wherein the linear movement in one direction causes a forward iteration through the plurality of flip book sub-panels and linear movement in a second direction, opposite the first direction causes backward iteration through the plurality of flip book sub-panels.

9. The greeting card of claim 1, wherein the second portion of the flip book panel is flush with a right edge of the greeting card body.

10. A greeting card comprising: a greeting card body having a first panel connected to a second panel along a first horizontal fold line and a third panel connected to the second panel along a second horizontal fold line, each panel having a front surface and a back surface; the third panel having a first generally elongated aperture located proximate to the center of the third panel and a second generally elongated aperture located proximate to a side edge of the third panel; a single contiguous flip book panel having a first end and a second end opposite the first end and a plurality of fold lines between the first and second ends; wherein the flip book panel is folded along each of the plurality of fold lines creating a plurality of sub-panels, each sub-panel being arranged in a stacked configuration and containing substantially similar artwork printed thereon; wherein the first end of the flip book panel is connected to the front surface of the third panel of the greeting card body and inserted through the first and second generally elongate apertures; wherein the back surface of the third panel of the greeting card body is folded over the back surface of the second panel and attached thereto, and wherein movement of the flip book panel away from the greeting card body causes sequential movement of each flip book sub-panel.

11. The greeting card of claim 10, wherein the first panel of the greeting card body is folded over the second panel such that the back surface of the first panel is in direct contact with the front surface of the third panel and the flip book panel.

12. The greeting card of claim 10, wherein the greeting card body is substantially rectangular.

13. The greeting card of claim 10, wherein movement of the flip book panel toward the greeting card body causes reverse sequential movement of each flip book sub-panel.

14. The greeting card of claim 10, wherein the movement of the flip book panel away from the greeting card body is in a horizontal direction.

15. The greeting card of claim 10, wherein the movement of the flip book panel away from the greeting card body is in a vertical direction.

16. The greeting card of claim 10, wherein the greeting card body and the plurality of flip book sub-panels contain similarly themed artwork.

17. The greeting card of claim 10, wherein each of the plurality of flip book sub-panels contains a slight variation in the artwork from every other flip book sub-panel.

18. The greeting card of claim 10, wherein the first fold line between the first and second panels of the greeting card body is a top edge of the greeting card body.

19. The greeting card of claim 10, wherein the first fold line between the first and second panels of the greeting card body is a left side edge of the greeting card body.

* * * * *